United States Patent [19]

Owens et al.

[11] 3,941,268

[45] Mar. 2, 1976

[54] SAFETY CLOSURE AND CONTAINER

[75] Inventors: Edward W. Owens, Shippenville, Pa.; Ned J. Smalley, Perrysburg, Ohio

[73] Assignee: Owens-Illinois, Inc., Toledo, Ohio

[22] Filed: Jan. 8, 1975

[21] Appl. No.: 539,262

[52] U.S. Cl. ..... 215/216; 215/218

[51] Int. Cl.[2]. B65D 55/02; B65D 85/56; A61J 1/00

[58] Field of Search ..... 215/9, 216, 218

[56] References Cited

UNITED STATES PATENTS

| | | | |
|---|---|---|---|
| 3,826,395 | 7/1974 | Montgomery | 215/9 |
| 3,830,391 | 8/1974 | Uhlig | 215/9 |

*Primary Examiner*—George T. Hall

*Attorney, Agent, or Firm*—A. J. Steger; E. J. Holler

[57] ABSTRACT

A child-resistant liquid seal closure and container combination featuring one or more camming projections on the container neck and one or more locking lugs on the interior surface of the closure which engage the camming projections to prevent rotational removal of the closure from the container. The closure may be removed from the container only by squeezing the closure on opposite sides to force the locking lugs radially outwardly beyond the camming projections to permit rotation of the closure relative to the container. The camming projections on the container neck are of sufficient axial height to prevent rotation of the closure relative to the container both when the closure is fully tightened onto the container and when the closure has been rotated 180° relative to the container, thereby necessitating two separate squeezing actions to remove the closure from the container. The closure of this invention has an outwardly tapered skirt which, when threadingly engaged on a straight cylindrical neck, provides sufficient space and resiliance to allow for squeezing of the closure to disengage the locking lugs from the camming projections.

3 Claims, 7 Drawing Figures

SAFETY CLOSURE AND CONTAINER

BACKGROUND OF THE INVENTION

This invention relates to closures for containers and more particularly, it relates to closures for containers of dangerous or harmful contents which are of the child-resistant type to deter access to the contents of the container by children. In other words, the closure and container are so constructed that the closure may be easily positioned on the container into a locking position, but in order to remove the closure from the container, some considerable thought and specific intent is necessary. The closure and container neck each have mating threaded portions which facilitate the attachment of the closure to the container neck. The closure also includes one or more locking lugs on its interior surface which engage one or more camming projections on the neck of the container to prevent rotational removal of the closure from the container. The closure may be removed from the container only by squeezing the closure on opposite sides to force the locking lugs radially outwardly beyond the camming projections to permit rotation of the closure relative to the container. The camming projections on the container neck are of sufficient axial height to prevent rotation of the closure relative to the container both when the closure is fully tightened onto the container and when the closure has been rotated 180° relative to the container, thereby necessitating two separate squeezing actions to remove the closure from the container.

The prior art has suggested many types of safety caps and container configurations for keeping poisons, dangerous chemicals and other medications away from children or unsuspecting adults. Examples of such prior art patents which disclose safety caps of the type that are squeezed in order to facilitate removal of the cap from the container include U.S. Pat. Nos. 3,376,991 (Deaver) and 3,830,391 (Uhlig).

The prior art devices of the squeeze-and-turn type have heretofore suffered in the respect that they have been difficult and expensive to manufacture or have required rather substantial changes to the mold for the threaded container neck portion. For example, the abovementioned Deaver patent requires an oval shape for the neck portion of the container, and the Uhlig patent requires flat cutaway portions on the container neck configuration. These modifications in the cited patents are required to provide space for squeezing the closure inwardly to disengage the locking means between the closure and the container neck.

In the safety cap field, it is usually desirable to require a relatively high degree of manual dexterity in removing the cap, but once it is removed, it is desired to replace it as quickly as possible without necessitating complicated maneuvers. It is also desirable to utilize a threaded engagement between the closure and container, as this type of engagement has been found to provide a very tight seal for maintaining the contents, particularly liquids, within the container.

SUMMARY OF THE INVENTION

It is therefore an object of this invention to provide a safety closure and container combination which incorporates a threaded engagement between the members for good liquid sealing characteristics and yet overcomes the disadvantages of the prior art devices which require expensive and complicated changes to the mold design of the container neck. The closure of this invention features one or more locking lugs on its interior surface which are adapted to provide a locking engagement with one or more projections on the neck portion of the container. The closure of this invention has an outwardly tapered skirt which, when threadingly engaged on a straight cylindrical container neck, provides sufficient space and resilience to allow for squeezing of the closure to disengage the locking lugs from the camming projections. Thus, the only modifications necessary to a standard cylindrical threaded neck portion of a container are the addition of one or more camming projections thereon.

The closure may be removed from the container only by squeezing the closure on opposite sides at positions spaced ninety degrees from the locking lugs radially outwardly beyond the camming projections to permit rotation of the closure relative to the container. The camming projections on the container neck are formed to be of sufficient axial height to prevent rotation of the closure relative to the container both when the closure is fully tightened onto the container and when the closure has been rotated 180° relative to the container, thereby necessitating two separate squeezing actions to remove the closure from the container.

Other objects, features and advantages of the subject invention will become apparent to one skilled in the art upon reference to the following detailed description and the drawings illustrating a preferred embodiment thereof.

IN THE DRAWINGS

DETAILED DESCRIPTION OF PREFERRED EMBODIMENTS OF THE INVENTION

Figure 4:
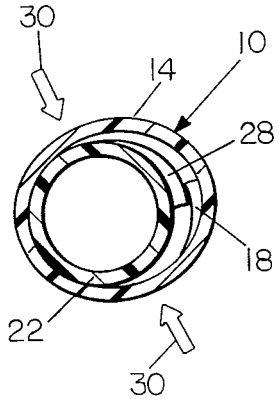
FIG. 4 is a sectional view of the closure and container neck with the closure rotated so that the locking members are out of engagement.
Figure 3:
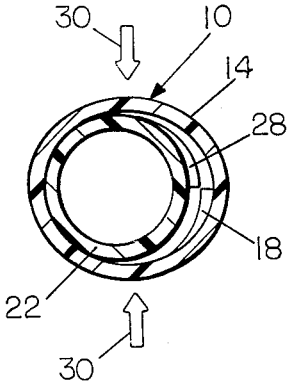
FIG. 3 is a sectional view of the closure and container neck with the closure being squeezed to disengage the locking means.
Figure 2:
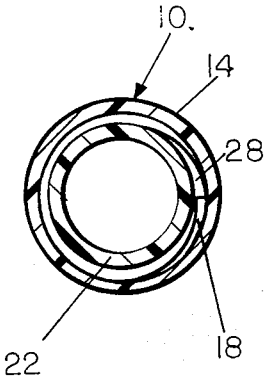
FIG. 2 is a sectional view of the closure and container neck in the locked position.
Figure 1:
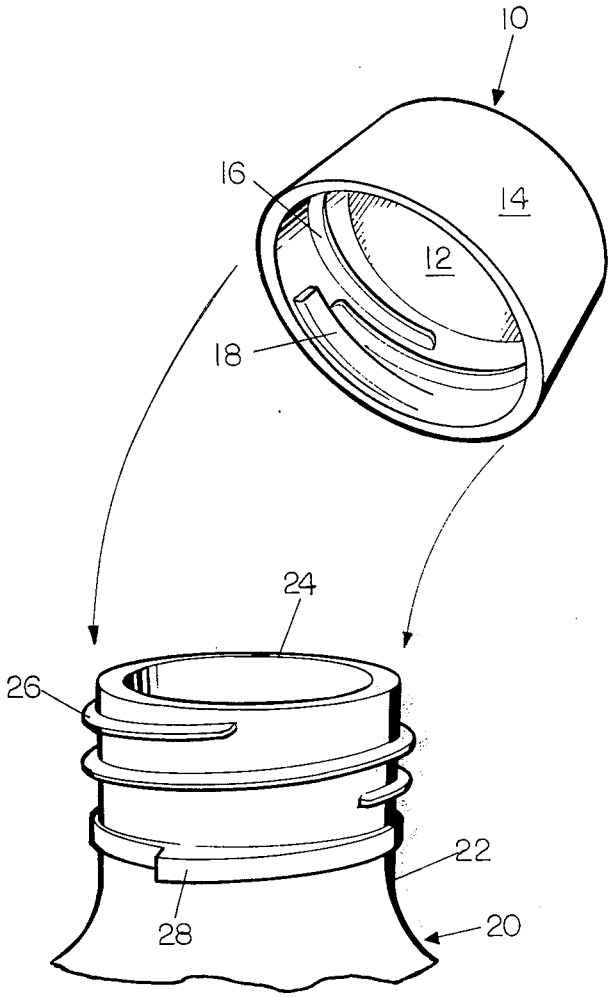
FIG. 1 is a perspective view of the child-resistant closure and container combination of this invention.
Figure 5:
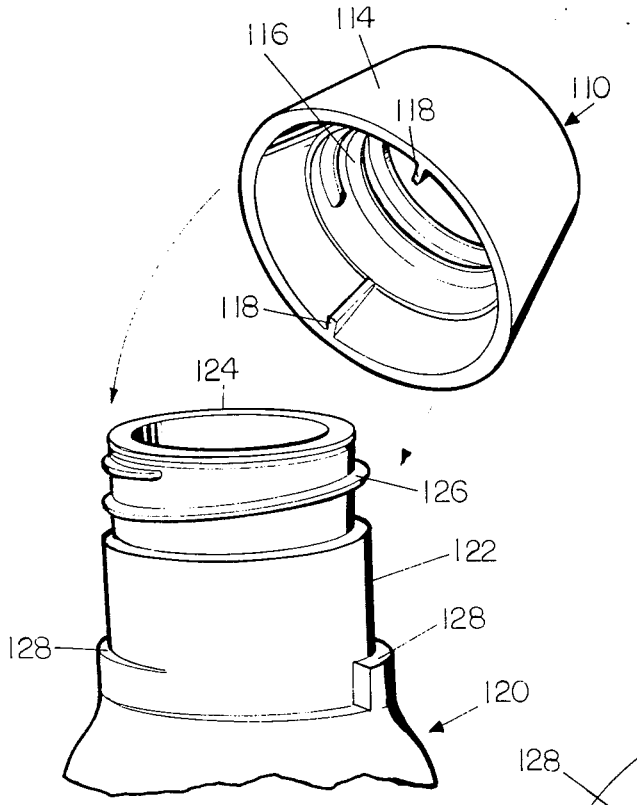
FIG. 5 is a perspective view of an alternate embodiment of the invention, wherein the closure and container neck each have a pair of mating locking members.
Figure 6:
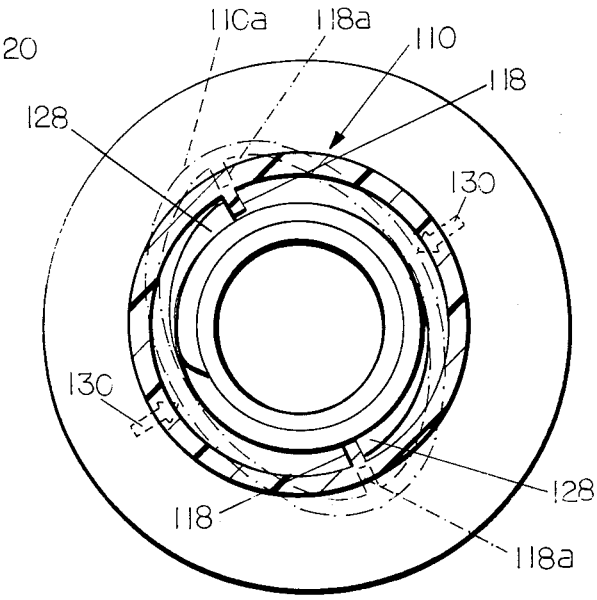
FIG. 6 is a sectional view of the closure and container neck of FIG. 5 showing the locking members in both the engaged and disengaged positions.
Figure 7:
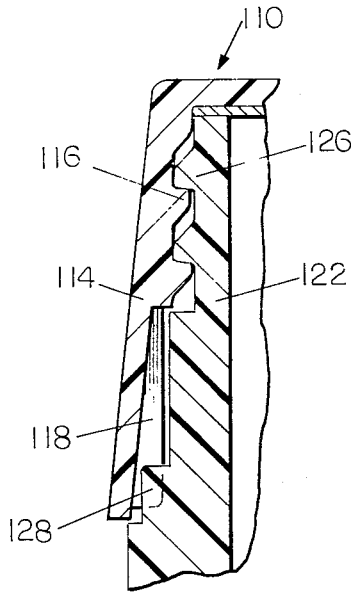
FIG. 7 is a sectional view of the closure and container neck of FIG. 5 showing the relationship of the tapered closure to the cylindrical container neck.

Referring now to the drawings, FIGS. 1 through 4 disclose an embodiment of this invention wherein the closure and container neck each have one locking member and FIGS. 5 through 7 disclose an embodiment wherein each of the closure and container necks have a pair of mating locking members. In FIG. 1, a closure, generally indicated by the numeral 10, is formed having a top panel 12 and a depending integral skirt portion 14. The interior of the skirt portion 14 incorporates a thread portion 16 and a single locking lug 18. The locking lug 18 is positioned adjacent to the lower edge of the skirt 14. A container, generally indicated by the numeral 20, incorporates a cylindrical neck 22 which terminates in an open mouth portion 24. The cylindrical neck 22 incorporates a thread 26 on its outer surface which is adapted to threadingly mate with the thread 16 on the closure 10. A camming projection 28 is formed on the outer surface of the neck 22 and is adapted to lockingly engage the locking lug 18 on the closure 10. The closure 10 may be applied to the container 20 by rotational movement, so that the mating threads 16 and 26 engage to secure the closure 10 to the container 20. As the closure 10 is threaded down onto the container 20, the locking lug 18 slides over the camming projection 28 until it snaps into engagement therewith. This position is shown in FIG. 2. To disengage the locking lug 18 from contact with the camming projection 28, it is necessary to apply a squeezing force to the closure 10 on opposite sides thereof, as shown by the arrows 30 in FIG. 3. Upon application of the force at locations approximately 90° from the mating locking members, the closure is distorted to the position shown in FIG. 3, thereby forcing the locking lug 18 radially outwardly to a position beyond the camming projection 28. While continuing to apply the force as indicated by the arrows 30, the closure 10 may be rotated relative to the container 20 as shown in FIG. 4, so that the locking lug 18 is rotated beyond the camming projection 28, and the closure may then be rotated or unscrewed from threaded engagement with the container 20.

Thus, the single locking member concept as shown in FIGS. 1 through 4 provides a relatively simple and economical solution to a liquid seal safety closure. It requires only minor changes, the addition of a locking lug to the closure and a camming projection to the container neck, to create a child-resistant safety closure. However, despite its simple design, it requires purposeful manipulation, the application of squeezing force at specified locations, to remove the closure from locking engagement with the container.

The alternate embodiment, as shown in FIGS. 5 through 7, is similar in concept to that shown in FIGS. 1 through 4. However, it requires the addition of a pair of camming projections to the container neck and a pair of locking lugs to the closure member. This second embodiment also provides a double locking feature, in that the closure must be squeezed at two specific locations in order to remove the closure from the container. In the FIG. 5 through 7 embodiment, a closure is indicated generally by the numeral 110. The closure 110 includes a top panel 112 and a depending annular skirt 114. The skirt 114 incorporates a thread portion 116 on its interior surface and a pair of locking lugs 118 on opposite sides of its interior surface. A container, indicated generally by the numeral 120 incorporates a cylindrical neck portion 122 which terminates in an open mouth 124. The container neck 122 includes a tapered thread portion 126 and a pair of camming projections 128. The closure 110 may be applied to the container 120 and secured thereto by the threaded engagement between the threads 116 and 126. As the closure 110 is rotated into threaded engagement with the container 120, the locking lugs 118 slide over the camming projections 128 until they rest in locking engagement therewith, as shown by the solid lines 118 and 128 in FIG. 6. In order to remove the closure 110 from locking engagement with the container 120, a squeezing force must be applied at opposite diametrical locations as indicated by the arrows 130 to force the closure into the position shown by the dotted lines **110*a* in FIG. 6. This distortion of the closure 110 to the position shown by 110*a* results in the outward movement of the locking lugs 118 to the positions shown in dotted lines and indicated as 118*a*. While continuing to maintain the squeezing force, the closure 110 may now be rotated out of engagement with the camming projections 128. If the squeezing force is then released, the closure may then be rotated for the remainder of a 180° rotation, and the locking lugs 118 will again engage the camming projections 128. It is then necessary to apply a second squeezing force to again distort the closure and force the locking lugs 118 outwardly beyond the camming projections 128 to continue rotational removal of the closure from the container. By carefully sizing the height of the camming projections 128**, this double locking feature, as previously described, requires either the continuous application of squeezing pressure on the closure while rotating the closure through more than one-half turn of rotation or the application of two separate squeezing efforts during the removal of the closure.

It can be seen in FIG. 7 that the closure 110 is provided with a sufficient taper relative to the container neck 122 to result in sufficient clearance between members to facilitate distortion of the closure upon the application of squeezing force. As indicated earlier, prior art devices have required either an oval-shaped container neck or flat surfaces on opposite sides of the container neck in order to provide adequate clearance for distortion of the closure in order to unlock it prior to its removal. However, the provision of a tapered closure, as shown in FIG. 7 and taught by this invention, eliminates the need for such modifications to the neck configuration of the container. Thus, the embodiment shown in FIGS. 5 through 7, while similar through principle and operation to that shown in FIGS. 1 through 4, provides the additional safety feature of having the closure locked into engagement with the container on two separate positions of rotation of the closure relative to the container. This double-safe feature requires more mental effort and manipulative skill to thereby make it more difficult for a child to reach the contents of the container.

As is the case with some of the prior art devices, the mating threads should be positioned so that continued tightening of the closure onto the container to effect a liquid seal may occur after the locking means have snapped into engagement. It should also be understood that the closure of this invention may incorporate a liner so as to provide an effective liquid seal when utilized with a glass container. The closure can be utilized with or without a liner to effect a seal with a plastic container.

We claim:

1. A double-locking, child-resistant closure and container combination comprising:

a container having a generally cylindrical neck portion with threads formed on the exterior thereof, and a pair of camming projections formed on diametrically opposite sides of said threaded neck portion; and a closure having a top panel and a tapered annular skirt portion depending therefrom, said annular skirt including threads formed on the interior surface thereof adapted to matingly engage the threads on the neck portion of said container, a pair of locking lugs formed on diametrically opposite sides of the interior surface of said annular skirt, said locking lugs being positioned for locking engagement with said camming projections to prevent removal of said closure from said container neck when said closure is in threaded engagement with said container neck, said tapered annular skirt being flexible to permit purposeful squeezing thereof at locations spaced 90° from said locking lugs to displace said locking lugs outwardly beyond said camming projections to permit rotation of said closure relative to said container neck to thereby remove the closure from threaded engagement with the container, said pair of camming projections on said container neck being of sufficient height to engage said pair of locking lugs in at least two different rotational positions of the closure relative to said container.

2. A double-locking, child-resistant closure and container combination as set forth in claim 1, wherein said locking lugs engage said camming projection both when said closure is fully tightened onto the container and when the closure has been rotated 180° relative to the container.

3. A double-locking, child-resistant closure and container combination as set forth in claim 2, wherein said locking lugs extend from the threads on the interior surface of said closure skirt to the bottom edge of said skirt.

* * * * *